US006893292B2

(12) United States Patent
Yamamoto et al.

(10) Patent No.: US 6,893,292 B2
(45) Date of Patent: May 17, 2005

(54) CONNECTOR

(75) Inventors: Takayuki Yamamoto, Shizuoka-ken (JP); Chieko Torii, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/627,628

(22) Filed: Jul. 28, 2003

(65) Prior Publication Data

US 2004/0023564 A1 Feb. 5, 2004

(30) Foreign Application Priority Data

Jul. 30, 2002 (JP) ..... 2002-222118

(51) Int. Cl.[7] ..... H01R 13/42
(52) U.S. Cl. ..... 439/595; 439/701
(58) Field of Search ..... 439/701, 752, 439/595

(56) References Cited

U.S. PATENT DOCUMENTS 5,651,700 A * 7/1997 Sato et al. ..... 439/595
6,059,612 A * 5/2000 Aoyama et al. ..... 439/701
6,422,887 B1 7/2002 Myer et al.

* cited by examiner

*Primary Examiner*—Renee Luebke
(74) *Attorney, Agent, or Firm*—Finnegan, Henderson, Farabow, Garrett & Dunner, L.L.P.

(57) ABSTRACT

A connector includes a connector housing configured to receive terminal fixtures inside of the connector housing. The connector includes a locking member including an arm having an end supported by an outer peripheral wall, and configured to lock with a mating connector in an engagement state due to flexible deformation of the arm. The connector includes a front holder inserted in the connector housing from an engagement side of the connector housing for preventing the terminal fixtures from falling off. The connector includes a flex-prevention locking mechanism between the outer peripheral wall and the front holder for preventing the outer peripheral wall from flexing.

17 Claims, 14 Drawing Sheets

CONNECTOR

BACKGROUND OF THE INVENTION

The present invention relates to a connector and, more specifically, to a connector for use in a vehicle. This connector prevents a terminal fixture from falling out of a connector housing during the assembly of a front holder with the connector housing.

This type of conventional connector includes a plurality of terminal fixtures to which ends of electric wires are connected. The connector includes a connector housing in which the plurality of terminal fixtures are housed. The connector includes a front holder assembled with the connector housing. The connector housing supports a locking member thereon.

SUMMARY OF THE INVENTION

However, in the connector, during the processes of engaging with and disengaging from a mating connector, a locking portion is flexed and deformed to deform the connector housing outwardly. This deformation weakens the locking force due to deformation of the locking member on recovering from the flex, and degrades reliability of the locking portion. The deformation causes the connector housing to be interfered with the mating connector, and precludes the smooth engaging or disengaging work of the mating connector.

The present invention is directed to prevent a deformation of a connector housing, while a mating connector is engaged with or disengaged from a connector.

A first aspect of the invention is directed to a first connector. The connector includes a connector housing configured to receive a terminal. The connector includes a locking member on the connector housing. The locking member is configured to lock with a mating member. The connector includes a holder mated with the connector housing. The holder is configured to hold the terminal. The connector includes a locking mechanism configured to lock the connector housing and the holder with each other against the locking member.

Preferably, the locking mechanism includes a dovetail joint.

Preferably, the dovetail joint includes a dovetail groove provided to one of the connector housing and the holder. The dovetail joint includes a locking projection provided to the other one of the connector housing and the holder. The locking projection is inserted in the dovetail groove.

Preferably, at least one of the dovetail groove and the locking projection converges in an insertion direction of the holder into the connector housing.

Preferably, the connector housing includes a support supporting the locking member. The locking mechanism is positioned to the holder in coincidence with the support.

A second aspect of the invention is directed to a second connector. The connector includes a connector housing configured to receive terminal fixtures inside of the connector housing. The connector includes a locking member including an arm having an end supported by an outer peripheral wall, and configured to lock with a mating connector in an engagement state due to flexible deformation of the arm. The connector includes a front holder inserted in the connector housing from an engagement side of the connector housing for preventing the terminal fixtures from falling off. The connector includes a flex-prevention locking mechanism between the outer peripheral wall and the front holder for preventing the outer peripheral wall from flexing.

BRIEF DESCRIPTION OF THE ACCOMPANYING DRAWINGS

DETAILED DESCRIPTION OF THE PREFERRED EMBODIMENTS

Embodiments of the present invention will now be described below based on the drawings.

Figure 1:
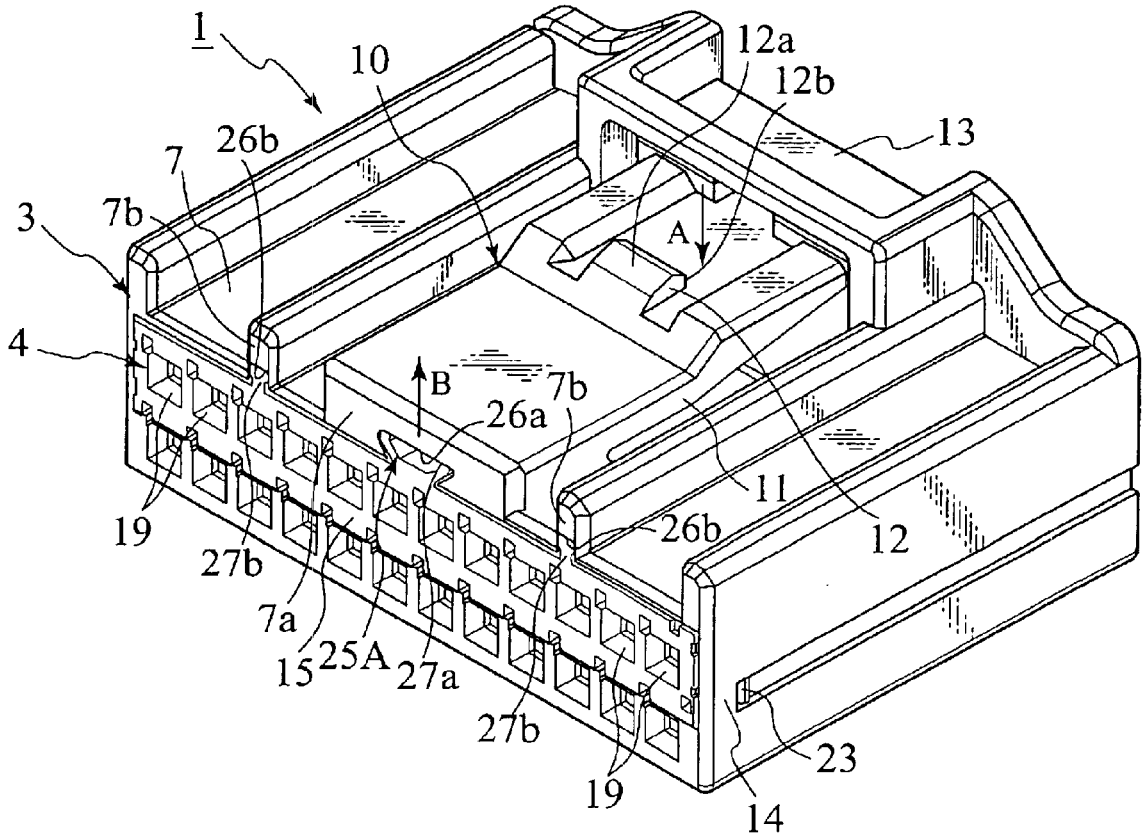
FIG. 1 is a perspective view of a connector provided with a front holder positioned in a primarily locked state in a first embodiment.
Figure 2:
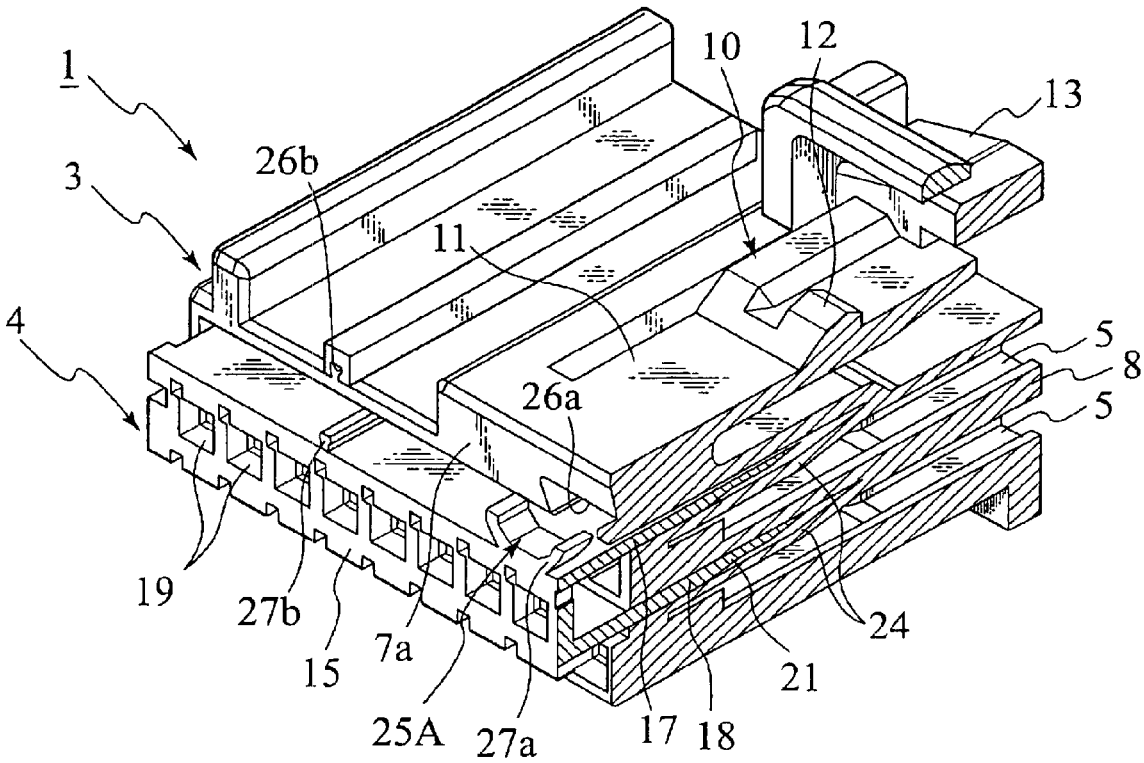
FIG. 2 is a partially broken perspective view of the connector of FIG. 1, which is provided with the front holder positioned in a provisionally locked state.

Referring to FIGS. 1 and 2, connector 1 includes a plurality of terminal fixtures (not shown) to which ends of electric wires are severally connected. Connector 1 includes housing 3 in which the plurality of terminal fixtures is housed. Connector 1 includes front holder 4 assembled with housing 3.

Figure 3:
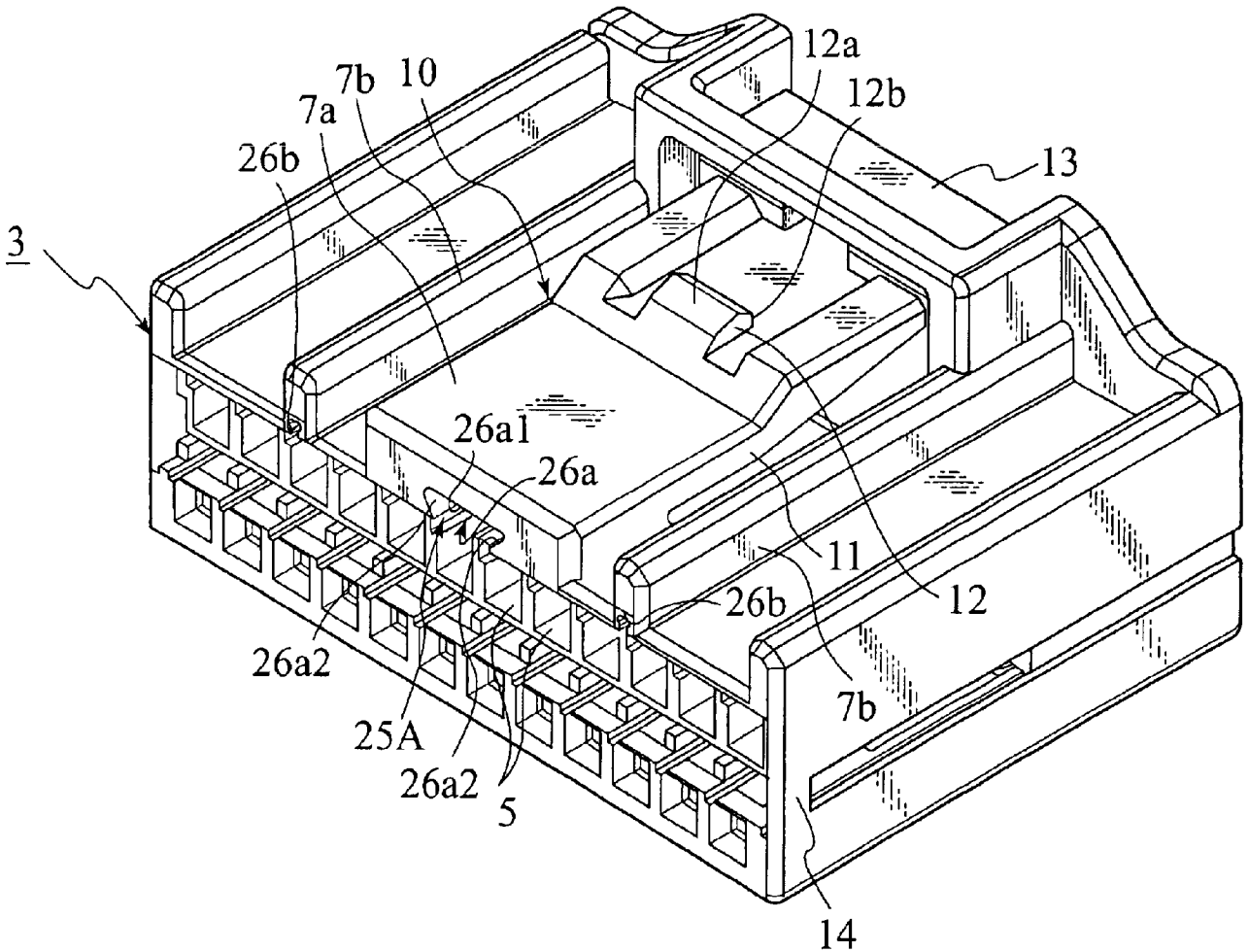
FIG. 3 is a perspective view of a housing in FIG. 1.

Referring to FIGS. 2 and 3, approximately flat rectangular-shaped housing 3 includes many terminal-receiving chambers 5 therein. Each chamber 5 includes the terminal fixture housed therein. Many chambers 5 are arranged at vertically two stages and arrayed side-by-side. Each chamber 5 includes front and rear surfaces open to the outside. Each chamber 5 at an upper stage includes a flexible locking arm 24 that extends from an inner surface of outer peripheral wall 7. Each terminal receiving chamber 5 at a lower stage includes a flexible locking arm 24 extending from a lower surface of partition 8. Each of locking arms 24 is locked with each of the terminal fixtures.

Figure 4:
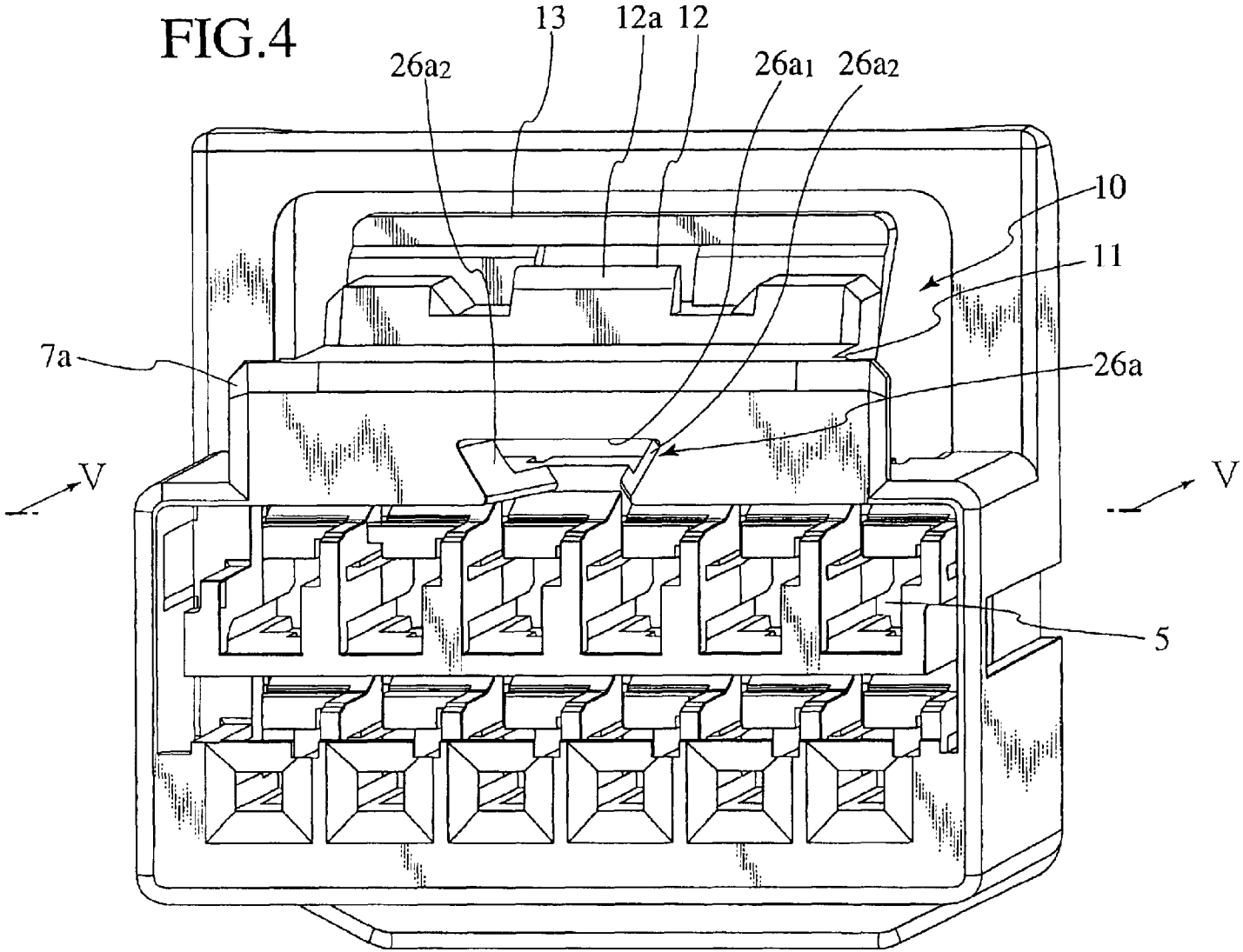
FIG. 4 is a perspective view of a primary portion of the housing in FIG. 3.

Referring to FIGS. 3 and 4, housing 3 includes locking part 10 on a top surface of outer peripheral wall 7. Locking part 10 is locked with a mating connector (not shown) in an engagement state. Locking part 10 includes arm 11. Arm 11 has one end fixed to supporting portion 7*a* of outer peripheral wall 7. Arm 11 includes the other end as a free end extending rearward of housing 3. Locking part 10 includes locking projection 12 projecting from a top surface of the free end of arm 11. Locking part 10 includes operation part 13 for locking projection 12, close to the free end. Arm 11 is disposed, with a predetermined space maintained above the top surface of outer peripheral wall 7. When the top surface of the free end of arm 11 is subjected to external force A to press the top surface downward, arm 11 is flexed and deformed downward in the space between the top surface of outer peripheral wall 7 and arm 11.

The front surface of locking projection 12 and a part of the top surface of arm 11 in front of locking projection 12 defines inclined side 12*a*. The rear surface of locking projection 12 defines vertical side 12*b*.

Housing 3 allows front holder 4 to be inserted thereinto from an engagement surface (front surface) thereof. Housing 3 includes a provisional locked part (not shown) with which front holder 4 is provisionally locked. Housing 3 includes primary locked part 14 with which front holder 4 is primarily locked.

Figure 7:
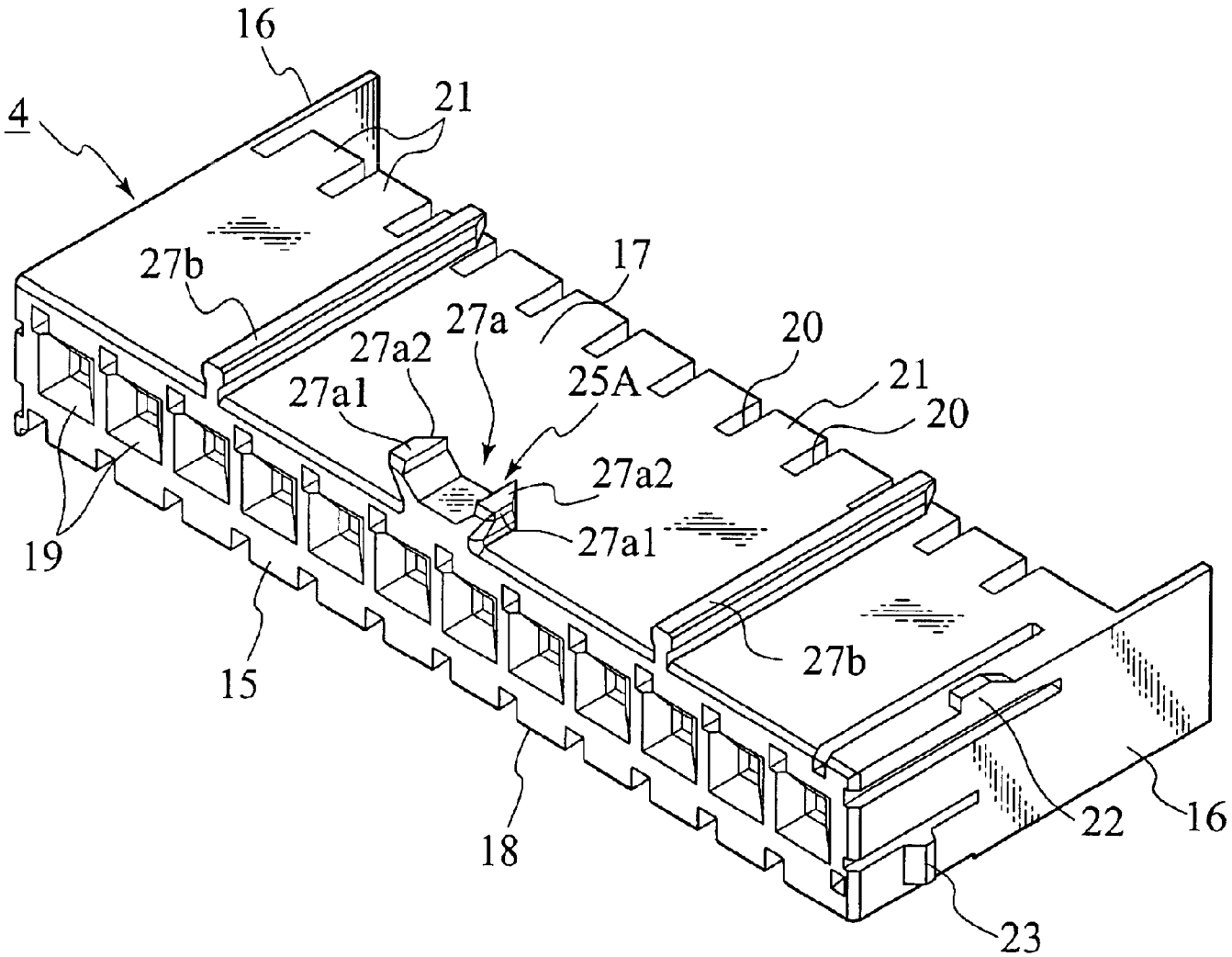
FIG. 7 is a perspective view of the front holder in FIG. 1.

Referring to FIGS. 2 and 7, front holder 4 includes front board 15. Front holder 4 includes a pair of side boards 16 that extend rearward from both side ends of front board 15. Front holder 4 includes top board 17 and bottom board 18 that extend rearward from top and bottom ends of front board 15. Front holder 4 is inserted into housing 3 with rears of side boards 16 as insertion ends. Front board 15 defines terminal-insertion openings 19 on the upper stage. Each rear end of top and bottom boards 17 and 18 is branched into arm-deformation preventers 21 to define many cut-out grooves 20. Each preventer 21 is interposed in a flex space between the locking arm 24 and the top surface of chamber 5. One of side boards 16 has provisional locking projection 22 on the top surface thereof, and has primary locking projection 23 on the side surface thereof.

Referring to FIG. 1, top board 17 and outer peripheral board 7 of housing 3 include flex-prevention locking mechanism 25A therebetween. Locking mechanism 25A prevents a flex of outer peripheral wall 7 of housing 3. Locking mechanism 25A includes in total three main and sub dovetail grooves 26*a* and 26*b* provided on outer peripheral wall 7 on the top surface of housing 3. Locking mechanism 25A includes in total three main and sub locking projections 27*a* and 27*b* projecting from the top surface of top wall 17. When front holder 4 is inserted into housing 3, locking projections 27*a* and 27*b* are inserted into dovetail grooves 26*a* and 26*b*, respectively. Large main dovetail groove 26*a* is positioned on the center of outer peripheral wall 7, and is provided on supporting portion 7*a* of supporting arm 11. Small sub dovetail grooves 26*b* are symmetrically positioned side-by-side on outer peripheral wall 7, and is provided on guide projections 7*b* projecting from the top surface of outer peripheral wall 7. Dovetail grooves 26*a* and 26*b* gradually converge toward an insertion direction of front holder 4 into housing 3. This structure enhances the degree of contact, as locking projections 27*a* and 27*b* are inserted deeper into dovetail grooves 26*a* and 26*b*.

Figure 5:
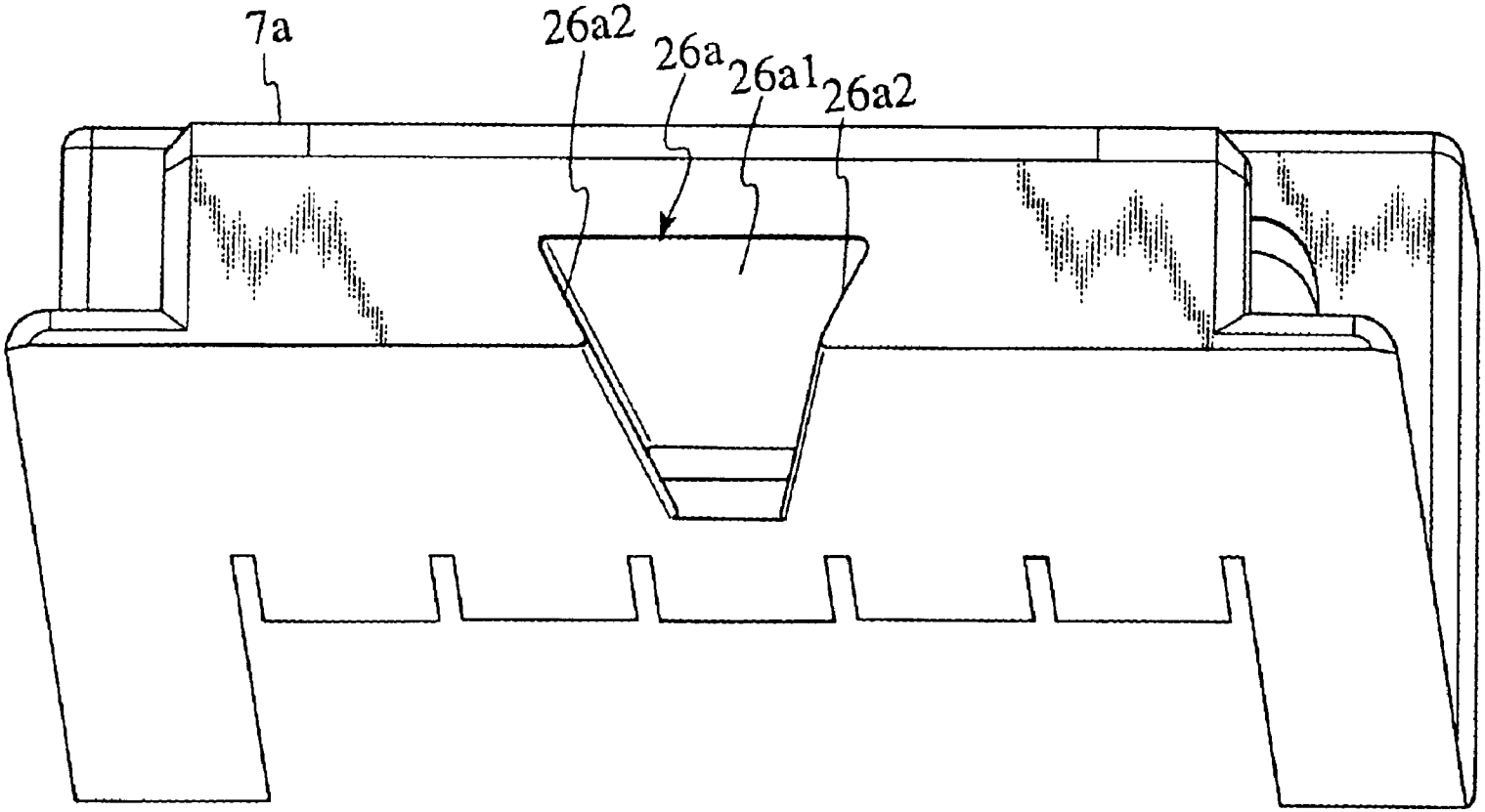
FIG. 5 is a broken perspective view of the primary housing taken along the line V—V in FIG. 4.
Figure 6:
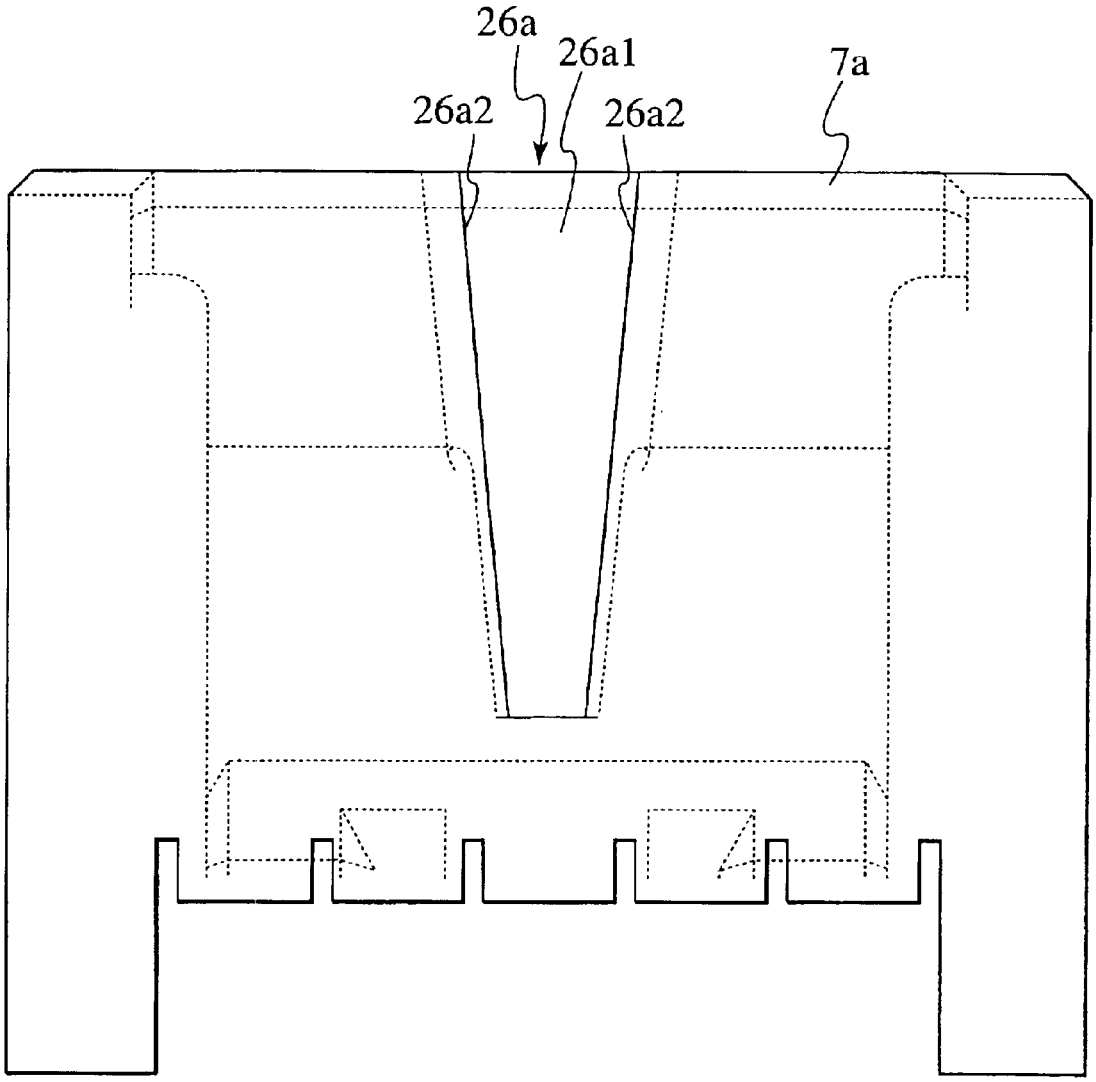
FIG. 6 is a broken side view of a primary portion in FIG. 5.

In FIGS. 5 and 6, trapezoidal dovetail groove 26*a* includes bottom wall 26*l*1. Dovetail groove 26*a* includes a pair of sidewalls 26*a*2 inclined at an acute angle relative to bottom wall 26*a*1. Sidewalls 26*a*2 come closer to each other toward the ends to define an opening at the ends.

In FIG. 7, V-shaped locking projection 27*a* includes a pair of arms 27*a*1 that are opposed to each other at an interval. Arms 27*a*1 include tapers 27*a*2 at their ends in an insertion direction into dovetail groove 26*a*, respectively. Tapers 27*a*2 come closer to each other as they extend their ends. Arms 27*a*1 are engaged with the sidewalls 26*a*2 of dovetail groove 26*a*. Tapers 27*a*2 facilitate insertion of arms 27*a*1 into dovetail groove 26*a* and serve as a dovetail joint.

Figure 8:
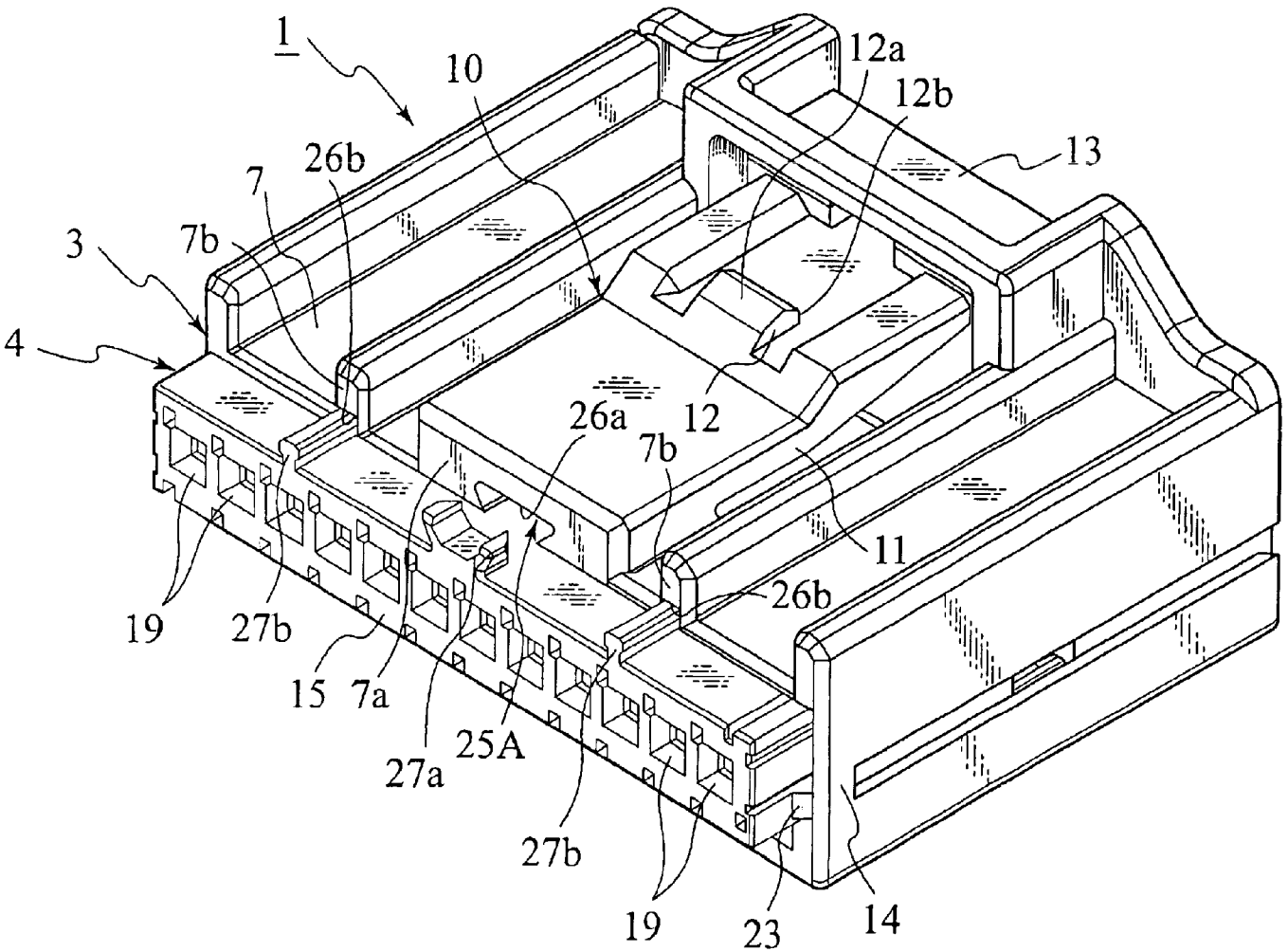
FIG. 8 is a perspective view of the connector of FIG. 1, which is provided with the front holder positioned in the provisionally locked state.

Next, the assembly work of connector 1 will be described. Referring to FIGS. 2 and 8, front holder 4 is inserted from the engagement surface (front surface) of housing 3. This insertion allows sub locking projections 27*b* to be partially inserted into sub dovetail grooves 26*b*. Locking projections 27*b* are inserted into grooves 26*b* to a position where provisional locking projection 22 of front holder 4 is locked with the provisional locked part (not shown) in housing 3. This insertion allows provisional locking. On this provisional locking, each terminal fixture (not shown) is inserted from a rear opening of each chamber 5 of housing 3. This insertion allows an insertion end of each terminal fixture to abut against each locking arm 24. From this state, each terminal fixture is further inserted. Each terminal fixture elastically deforms the free end of the locking arm 24 in the flex space, which allows insertion of the terminal fixture. Each terminal fixture is inserted to an appropriate insertion position. This insertion allows the free end of the locking arm to coincide with a locked part (not shown) of the terminal fixture. The insertion allows locking arm 24 to be resiliently restored to lock with the terminal fixture.

Next, on the engagement surface (front surface) of housing 3, provisionally locked front holder 4 is further inserted into housing 3. This insertion allows sub locking projections 27*b* to be inserted more deeply into dovetail grooves 26*b*, and main locking projection 27*a* to be inserted into main dovetail groove 26*a*. Referring to FIG. 1, front holder 4 is inserted into housing 3 to a position where primary locking projection 23 of front holder 4 is locked with main locked part 14 of housing 3, thus achieving primary locking. The insertion of front holder 4 allows each preventer 21 to be inserted into the flex space between each locking arm 24 and the top surface of each chamber 5. Each preventer 21 restricts a flexural deformation of each locking arm, thus preventing the fall of each terminal fixture.

Next, a mating connector (not shown) is engaged with assembled connector 1 from the engagement surface (front surface). This engagement allows each terminal (not shown) of the mating connector to be inserted into each chamber 5. This insertion allows a locked part (not shown) of the mating connector to abut on inclined side 12*a* of arm 11. In this state, the mating connector is further engaged. Arm 11 is flexed and deformed in the arrow direction A, and allows engagement of the mating connector with connector 1. The mating connector is engaged to an appropriate engagement position. This engagement allows the terminals of the mating connector to be electrically connected to the terminal fixtures (not shown). This engagement positions the locked part of the mating connector such that the locked part lies over locking projection 12 of locking part 10, thus allowing arm 11 to be resiliently restored. This restoring allows the locked part of the mating connector to be locked with locking projection 12, thus locking the engaged mating connector with connector 1.

In order to disengage the mating connector in the engaged state, operation part 13 of locking part 10 is forced to flex and deform in the arrow direction A. When the mating connector is pulled apart from connector 1, both of them can be separated.

During the process of the engaging or disengaging operations of the mating connector, arm 11 of locking part 10 is flexed and deformed in the arrow direction A. This flexural deformation allows force in the arrow direction B to be exerted on the portion of outer peripheral wall 7 of housing 3 that supports arm 11. This force tends to displace outer peripheral wall 7 upward. This upward force is transmitted to front holder 4 through dovetail grooves 26*a* and 26*b* and through locking projections 27*a* and 27*b* engaged therewith. Front holder 4 prevents displacement of outer peripheral wall 7. Not only outer peripheral wall 7 of housing 3 but also top wall 17 of front holder 4 is subjected to the force of displacing upward outer peripheral wall 7, thus preventing the displacement of outer peripheral wall 7. Thus, outer peripheral wall 7 of housing 3 is not displaced upward, while the mating connector is engaged and disengaged. This does not degrade the reliability of locking part 10, nor does it preclude the smooth engaging and disengaging work of the mating connector.

The first embodiment is set such that dovetail grooves 26*a* and 26*b* gradually converge toward the insertion direction of front holder 4 into housing 3 to enhance the degree of contact as locking projections 27*a* and 27*b* are inserted deeper into dovetail grooves 26*a* and 26*b*. At an initial step during the insertion of locking projections 27*a* and 27*b* into dovetail grooves 26*a* and 26*b*, locking projections 27*a* and 27*b* are inserted into dovetail grooves 26*a* and 26*b* without any tight contact therebetween. This enables smooth insertion even if locking projections 27*a* and 27*b* do not completely coincide with dovetail grooves 26*a* and 26*b* in position. When locking projections 27*a* and 27*b* are inserted into dovetail grooves 26*a* and 26*b* to insertion completion positions, locking projections 27*a* and 27*b* are brought into tight contact with dovetail grooves 26*a* and 26*b* under a large contact force. This tight-contact eliminates any play between outer peripheral wall 7 of housing 3 and front holder 4, and prevents even a slight displacement of outer peripheral wall 7. Not dovetail grooves 26*a* and 26*b* but locking projections 27*a* and 27*b* may be constructed so as to gradually converge toward the insertion direction of front holder 4 into housing 3. Both of dovetail grooves 26*a* and 26*b* and locking projections 27*a* and 27*b* may be constructed so as to gradually converge toward the insertion direction of front holder 4 into housing 3. These structures also enhance the degree of contact as locking projections 27*a* and 27*b* are inserted deeper into dovetail grooves 26*a* and 26*b*.

Figure 9:
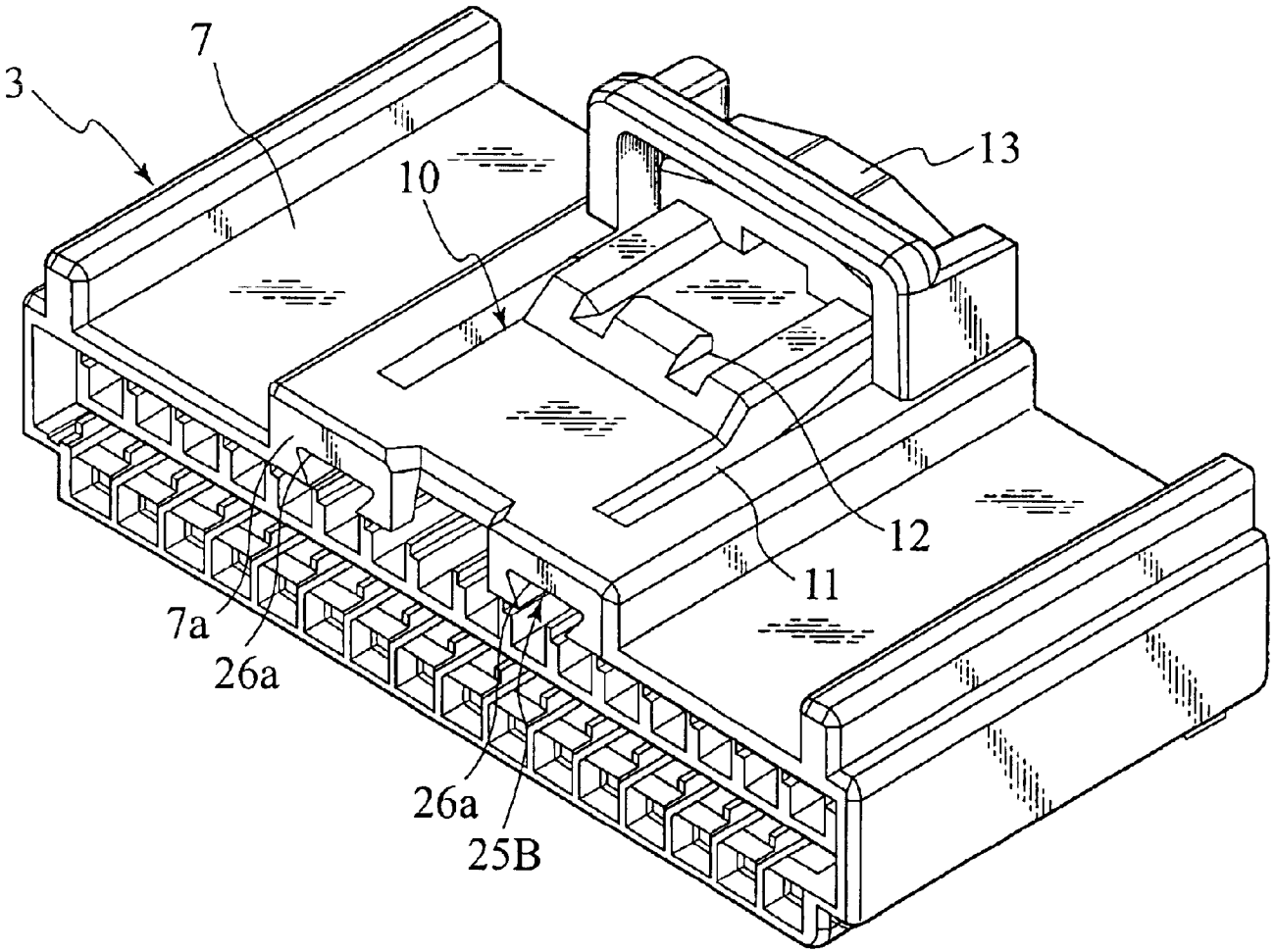
FIG. 9 is a perspective view of a housing of a second embodiment.
Figure 10:
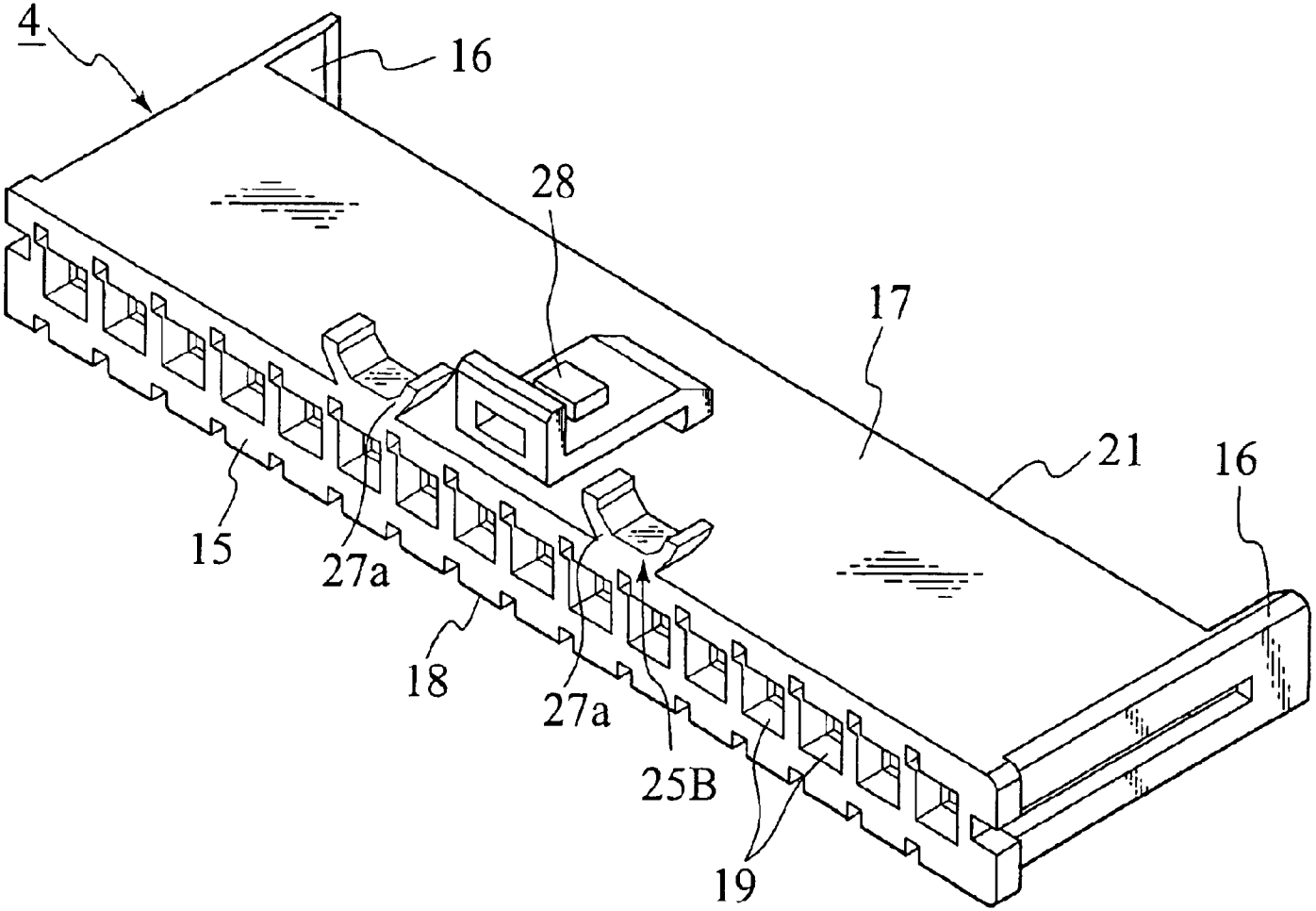
FIG. 10 is a perspective view of a front holder of the second embodiment.

Referring to FIGS. 9 and 10, flex-prevention locking mechanism 25B of a second embodiment includes two main dovetail grooves 26*a*, and two main locking projections 27*a*. Two main dovetail grooves 26*a* are provided on supporting portion 7*a* for arm 11. Primary locking projection 28 is disposed between locking projections 27*a*. On the other hand, flex-prevention locking mechanism 25A of the first embodiment includes in total three main and sub dovetail grooves 26*a* and 26*b* and in total three main and sub locking projections 27*a* and 27*b*. Hereinafter, the same and similar reference numerals will be applied to the same and similar members as those of the first embodiment, and description thereof will be omitted.

Figure 11:
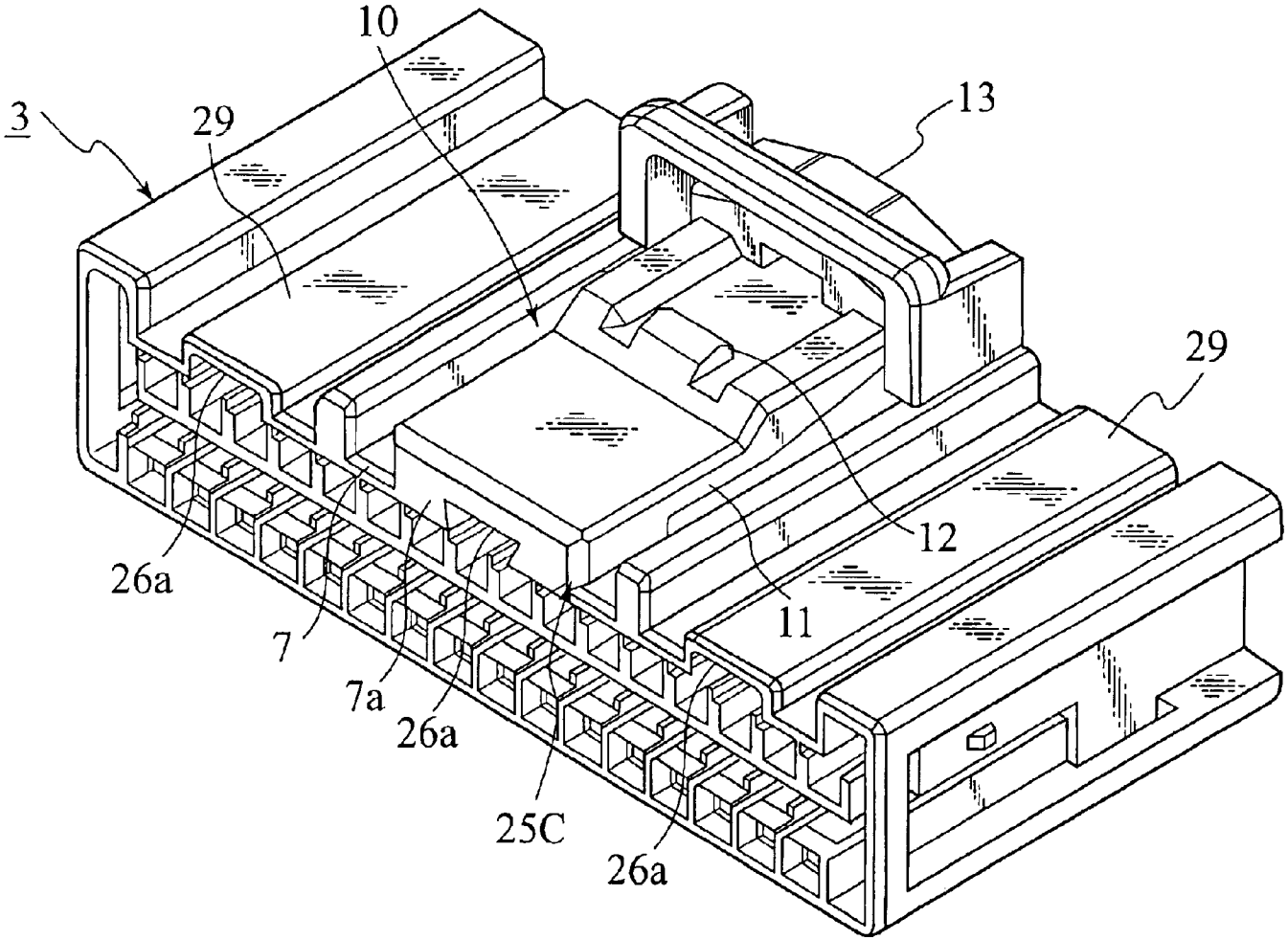
FIG. 11 is a perspective view of a housing of a third embodiment.
Figure 12:
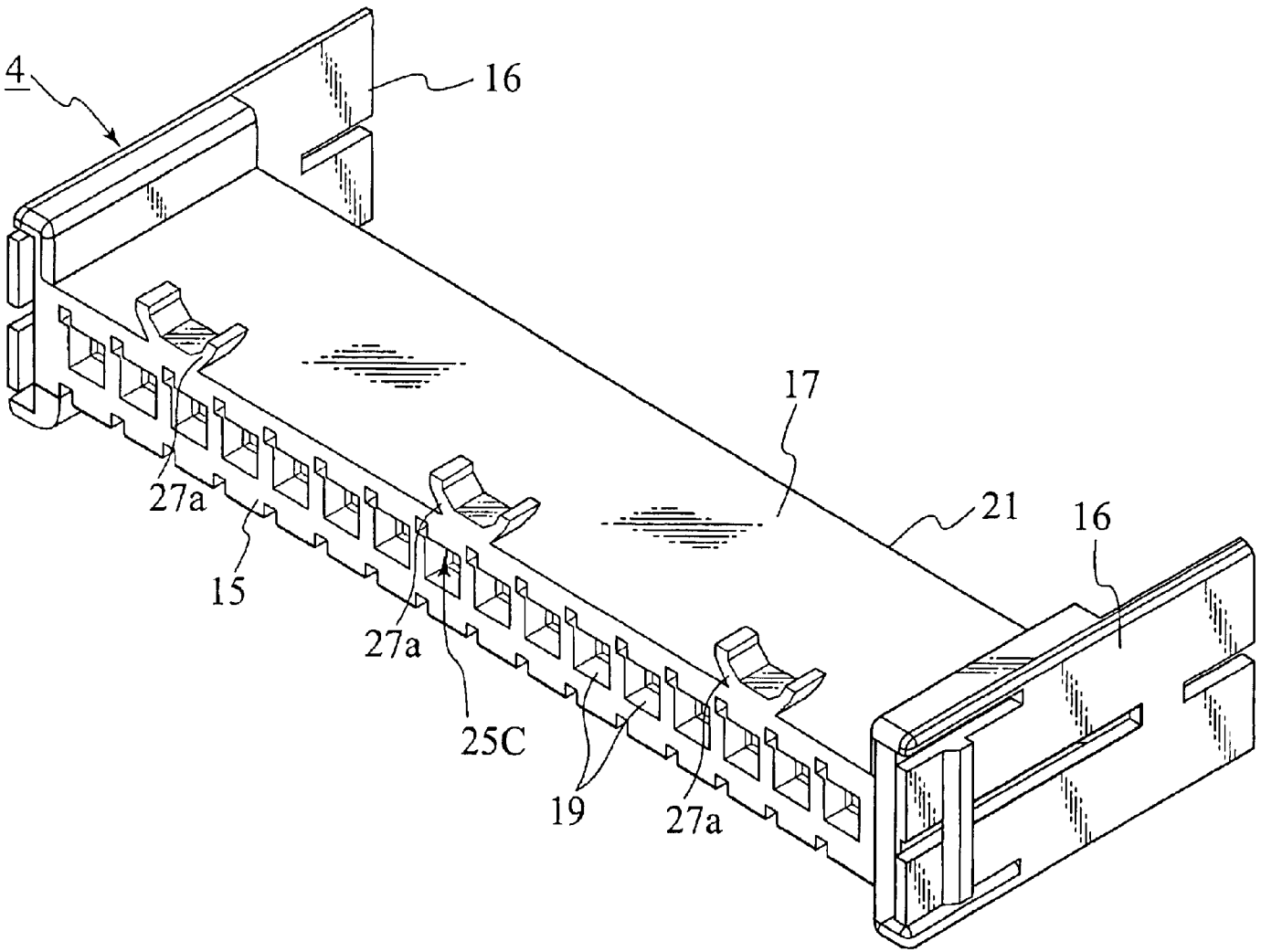
FIG. 12 is a perspective view of a front holder of the third embodiment.

Referring to FIGS. 11 and 12, flex-prevention locking mechanism 25C of a third embodiment includes three main dovetail grooves 26*a*, and three main locking projections 27*a*. Dovetail groove 26*a* in the center position is provided on supporting portion 7*a* for arm 11, and two right and left dovetail grooves 26*a* are provided on right and left wide guide projections 29, respectively.

Figure 13:
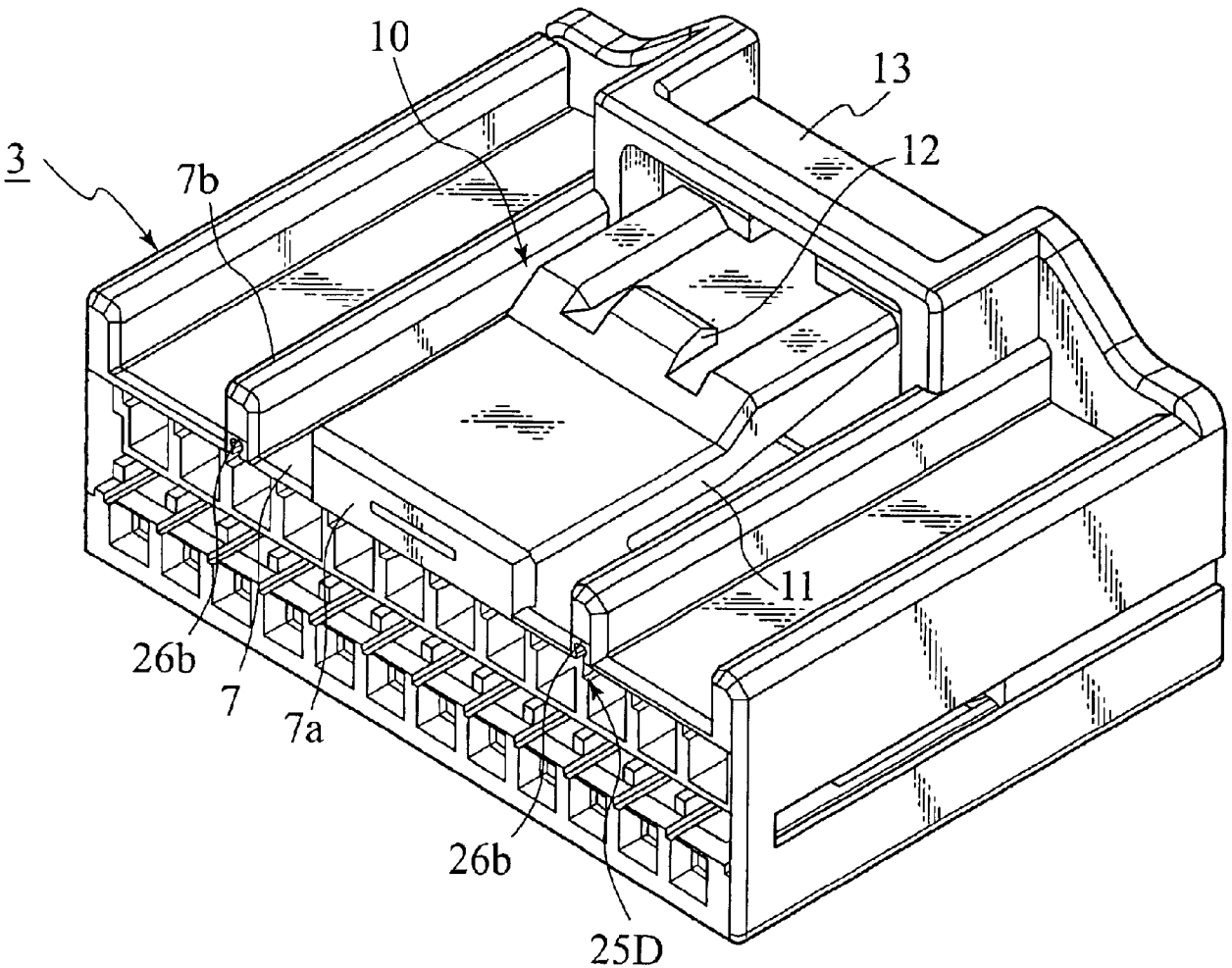
FIG. 13 is a perspective view of a housing of a fourth embodiment.
Figure 14:
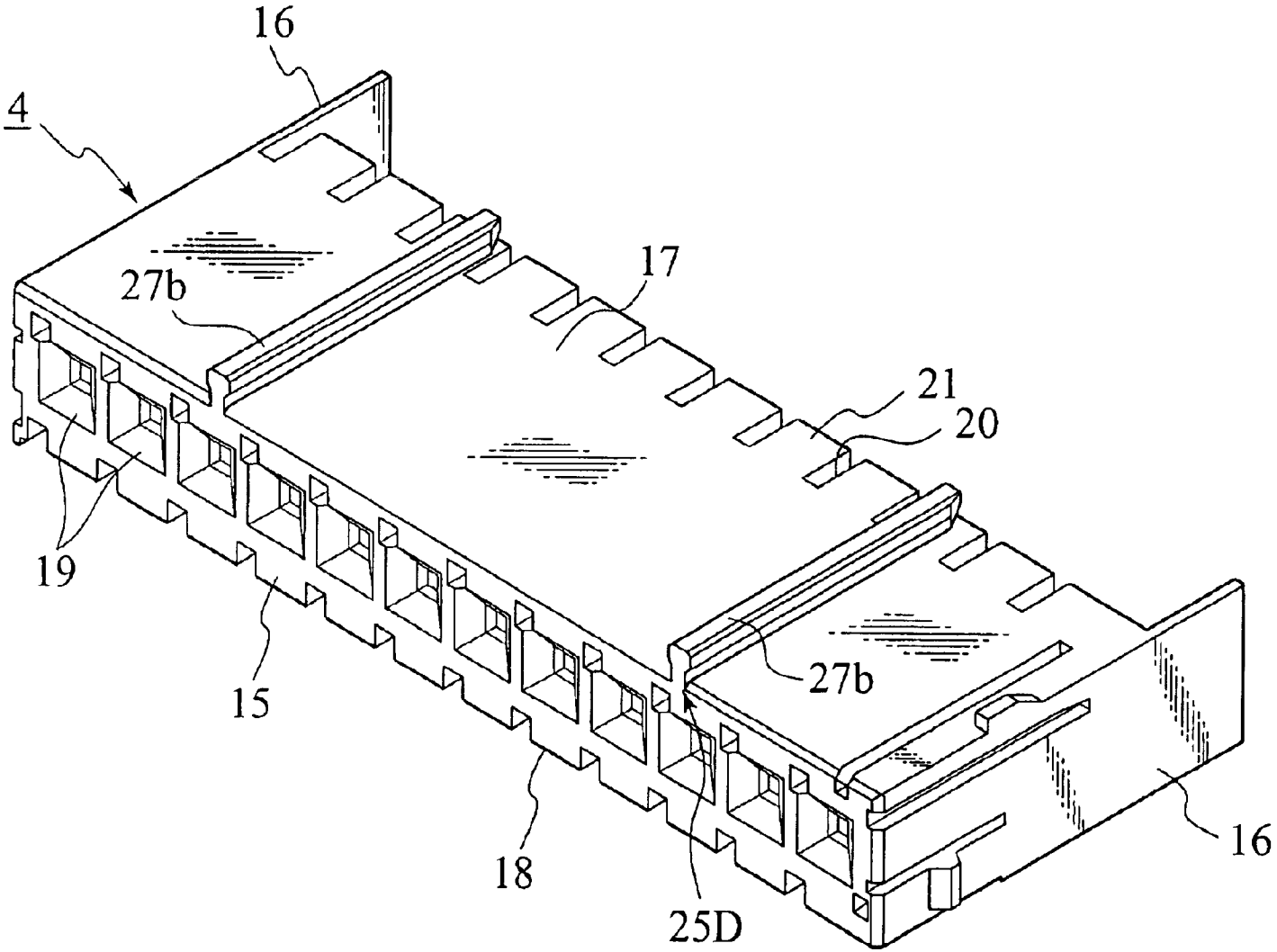
FIG. 14 is a perspective view of a front holder of the fourth embodiment.

Referring to FIGS. 13 and 14, flex-prevention locking mechanism 25D of a fourth embodiment includes two sub dovetail grooves 26*b* and two sub locking projections 27*b*. The other members are similar to those of the first embodiment.

According to the second to fourth embodiments, in a similar way to the first embodiment, outer peripheral wall 7 of housing 3 is not displaced upward while a mating connector is engaged or disengaged. This does not degrade the reliability of locking part 10, nor does it preclude the smooth engaging and disengaging of the mating connector.

In each of the first to third embodiments, each of locking mechanisms 25A to 25C is provided on supporting portion 7*a* of outer peripheral wall 7 that supports arm 11, and on the portion of front holder 4 that coincides with this supporting portion 7*a*. The force B tending to displace outer peripheral wall 7 upward is directly exerted on each of the flex-prevention locking mechanisms 25A to 25C, and the displacement of outer peripheral wall 7 can be prevented effectively.

In each of the first to fourth embodiments, each of locking mechanisms 25A to 25D includes either or both of dovetail grooves 26*a* and 26*b* provided on outer peripheral wall 7 of housing 3, and either or both of locking projections 27*a* and 27*b* provided on front holder 4. In addition, locking mechanisms 25A to 25D may include other structures than the structure of dovetail grooves as long as the flex of outer peripheral wall 7 of housing 3 can be prevented. In locking mechanisms 25A to 25D, the arrangement of dovetail grooves 26*a* and 26*b* and locking projections 27*a* and 27*b* in the first to fourth embodiments may be reversed. Locking projections 27*a* and 27*b* may be provided on outer peripheral wall 7 of housing 3, and dovetail grooves 26*a* and 26*b* may be provided on front holder 4.

The entire contents of Japanese Patent Applications P 2002-222118 (filed on Jul. 30, 2002) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

According to the invention, when an arm of a locking member is flexibly deformed during engaging with or disengaging from a mating connector, a force due to the flexible deformation exerts on a portion of an outer peripheral wall supporting the arm to be displaced upward. The upward displacing of the outer peripheral wall under the force allows upward force to be transmitted to a front holder through a flex-prevention locking mechanism. The front holder prevents upward displacement.

When the outer peripheral wall displaces upward, the upward external force transmits to the front holder through a locking projection fitted in a dovetail groove. The front holder prevents the displacement of the outer peripheral wall.

At an initial step during the insertion of the locking projection into the dovetail groove, the locking projection is inserted without tight contact with the dovetail groove. Even if both the locking projection and the dovetail groove slightly displace from each other, smooth insertion is achieved. When the locking projection is inserted at an insertion-completion position, the dovetail groove and the locking projection are brought into tight contact with each other under a great tight-contact force. The tight contact eliminates play between the outer peripheral wall and the front holder, which prevents slight displacement of the outer peripheral wall.

The locking mechanism is directly subjected to a force that causes upward displacement of the outer peripheral wall.

What is claimed is:

1. A connector comprising:

a connector housing having a terminal receiving side configured to receive a terminal and an engaging side opposite the terminal receiving side;

a locking member having an end fixed to a wall the connector housing between the terminal receiving side and the engaging side and a distal free end configured to lock with a mating member;

a holder cinfigured for inserition into the engaging side of the connector housing and to hold the terminal; and a locking mechanism configured to lock the wall of the connector housing to the holder to resist deflection of the wall during flexure of the locking member.

2. The connector according to claim 1, wherein the locking mechanism includes a dovetail joint.

3. The connector according to claim 2, wherein the dovetail joint includes:

a dovetail groove provided in one of the connector housing and the holder; and a locking projection provided on the other one of the connector housing and the holder and configured to slidably engage the dovetail groove.

4. The connector according to claim 3, wherein at least one of the dovetail groove and the locking projection converges in an insertion direction of the holder into the connector housing.

5. The connector of claim 1, wherein the locking mechanism includes a plurality of dovetail joints distributed across the wall of the connector housing.

6. The connector of claim 1, wherein the locking mechanism is aligned with a sliding engagement direction of the holder.

7. The connector of claim 1, further including a retention mechanism configured to resist separation of the holder from the connector housing.

8. The connector of claim 7, wherein the retention mechanism includes at least one locking projection located on one of the holder and the connector housing and configured to engage a channel located on the other of the holder and the connector housing.

9. The connector of claim 8, wherein the at least one projection includes at least one provisional projection for retaining the holder in a first position relative to the connector housing and at least one primary projection for retaining the holder in a second position relative to the connector housing.

10. The connector of claim 8, further including a flexible locking arm disposed on one of the holder and the connector housing and configured to retain the terminal.

11. The connector of claim 10, further including an arm deformation preventor located on the other of the holder and the connector housing and configured to prevent the flexible locking arm from flexing when the holder is engaged with the connector housing.

12. A connector comprising:

a connector housing having a terminal receiving side configured to receive terminal fixtures inside of the connector housing, an engaging side opposite the terminal receiving side, and an outer peripheral wall disposed between the terminal receiving side and the engaging side;

a front holder inserted in the connector housing from the engaging side of the connector housing for preventing the terminal fixtures from falling out of the connector housing;

a plurality of dovetail joints disposed between the outer peripheral wall and the front holder for preventing the outer peripheral wall from flexing; and a locking member including an arm having an end supported by the outer peripheral wall, and configured to lock with a mating connector in an engagement state due to flexible deformation of the arm.

13. The connector according to claim 12, wherein each of the plurality of dovetail joints includes:

a dovetail groove provided on one of the connector housing and the holder; and a locking projection provided on the other one of the connector housing and the holder and configured to slidably engage the dovetail groove, wherein at least one of the dovetail groove and the locking projection converges in an insertion direction of the holder into the connector housing.

14. The connector of claim 12, further including a retention mechanism configured to resist separation of the holder from the connector housing.

15. The connector of claim 14, wherein the retention mechanism includes at least one locking projection located on one of the holder and the connector housing and configured to engage a channel located on the other of the holder and the connector housing.

16. The connector of claim 12, further including a flexible locking arm disposed on one of the holder and the connector housing and configured to retain the terminal fixtures.

17. The connector of claim 16, further including an arm deformation preventor located on the other of the holder and the connector housing and configured to prevent the flexible locking arm from flexing when the holder is engaged with the connector housing.

* * * * *

UNITED STATES PATENT AND TRADEMARK OFFICE

CERTIFICATE OF CORRECTION

PATENT NO. : 6,893,292 B2
DATED : May 17, 2005
INVENTOR(S) : Takayuki Yamamoto et al.

It is certified that error appears in the above-identified patent and that said Letters Patent is hereby corrected as shown below:

Column 7,
Line 6, “wall the” should read -- wall of the --.
Line 10, “cinfigured” should read -- configured --; and “inserition” should read -- insertion --.

Signed and Sealed this

Eleventh Day of October, 2005

JON W. DUDAS
*Director of the United States Patent and Trademark Office*